US006041870A

United States Patent [19]

Zimmerman et al.

[11] Patent Number: 6,041,870

[45] Date of Patent: Mar. 28, 2000

[54] METHOD AND APPARATUS FOR STEERING A DOZING MACHINE

[75] Inventors: William H. Zimmerman, Edelstein; Thomas C. Meisel, Peoria, both of Ill.

[73] Assignee: Caterpillar Inc., Peoria, Ill.

[21] Appl. No.: 09/065,176

[22] Filed: Apr. 23, 1998

[51] Int. Cl.[7] ..... E02F 3/76

[52] U.S. Cl. ..... 172/811

[58] Field of Search ..... 172/811, 7, 278, 172/279, 281

[56] References Cited

U.S. PATENT DOCUMENTS

| | | | |
|---|---|---|---|
| 2,075,482 | 3/1937 | Thorpe | 37/144 |
| 2,218,512 | 10/1940 | Ball | 37/42 |
| 2,730,823 | 1/1956 | Cassidy | 37/144 |
| 3,759,110 | 9/1973 | Davis | 74/99 |
| 3,775,877 | 12/1973 | Gove, Sr. | 172/264 X |
| 3,941,195 | 3/1976 | Stedman | 172/801 |
| 4,211,282 | 7/1980 | Frisbee | 172/7 |
| 4,248,311 | 2/1981 | Frisbee et al. | 172/819 |
| 4,306,625 | 12/1981 | Davis | 172/819 |
| 4,369,847 | 1/1983 | Mizunuma | 172/815 |
| 4,463,507 | 8/1984 | Gaub | 172/820 |
| 4,919,212 | 4/1990 | McClure | 172/274 |
| 5,487,428 | 1/1996 | Yamamoto et al. | 172/4.5 |

*Primary Examiner*—Christopher J. Novosad
*Attorney, Agent, or Firm*—John J. Cheek

[57] ABSTRACT

A dozing machine comprises a tractor having a transverse dozing blade mounted at the forward end thereof. Steering changes can made by shifting the lateral centerline of the blade laterally relative to the longitudinal centerline of the tractor. To this end, a linear actuator is connected between the blade or a blade push arm and the tractor. The actuator is extended or retracted to shift the centerline of the blade. The centerline may also be shifted by extending the length of the blade to one side of the tractor centerline. Automated methods and apparatus are disclosed which utilize blade centerline shifting to maintain a desired direction of travel or to automatically achieve any desired path. Also, sideshifting of the blade may be useful for purposes other than steering the tractor.

26 Claims, 3 Drawing Sheets

METHOD AND APPARATUS FOR STEERING A DOZING MACHINE

TECHNICAL FIELD

This invention relates to a method and apparatus for steering a dozing machine and to a dozing machine in which the dozer blade thereof is shiftable on demand laterally relative to the machine.

BACKGROUND ART

Typical dozing machines comprise a tractor having a dozer blade carried at the front end thereof. In many instances, the tractor is a track-driven machine having a pair of mutually-spaced tracks that are driven to propel the machine. As such, ordinary steering of the machine is accomplished by varying the relative speed of the tracks. In simple cases, a conventional clutch and brake arrangement is provided to selectively cut power to one of the tracks to cause the machine to steer. In other machines, however, socalled differential steering is possible in which the speed of one track is increased while the speed of the opposite track is decreased.

One problem with the clutch and disc steering arises when the machine is operated with a substantial blade load. When power to one track is cut, the remaining driven track may not have sufficient tractive force to maintain the forward motion of the machine. This may be a particular concern when the machine is operated in a "cruise control" mode to maintain a desired forward speed. Thus, it is desirable during steering to maintain power to both tracks when operating under substantial blade loads to thereby maintain the forward speed of the machine. Differential steering may be used to address this problem but can be complex and adds to the cost of the machine.

One known solution to the aforementioned problem which does not require differential steering is the use of blade tilt steering. More particularly, steering can be accomplished by tilting the dozer blade about the longitudinal axis of the tractor to raise or lower one side of the blade during a push. Such blade tilting during a pushing operation causes the blade to dig deeper at one side, which creates a positive yaw rate. An example of blade tilt steering is described in U.S. Pat. No. 5,487,428, issued on Jan. 30, 1996, to Yamamoto et al. While blade tilt steering does provide an effective means for making course corrections, it presents other problems. Most notably, blade tilt steering can result in an uneven surface after dozing due to the various tilt angles that the blade occupies during a push.

This invention is directed to overcoming one or more of the above-described problems.

DISCLOSURE OF THE INVENTION

In accordance with one aspect of this invention, a method for controlling the direction of travel of an earth working machine is disclosed. The machine comprises a driving portion having a ground-engaging dozer blade at one end thereof which extends transverse to a longitudinal centerline of the driving portion. The dozer blade has a lateral centerline. With the lateral centerline of the dozer blade located at a first position relative to longitudinal centerline of the driving portion, the work machine is caused to travel in a predetermined direction of travel. While the machine is traveling, the machine is caused to change its direction of travel by shifting the lateral centerline of the dozer blade to a second position relative to the longitudinal centerline, the second position being spaced laterally from the first position.

In a related aspect, prior to shifting the lateral centerline of the dozer blade to the second position, the method comprises determining that the machine is no longer traveling in the predetermined direction. In this aspect, shifting of the lateral centerline of the blade to the second position is in response to the determining step and causes the machine to steer toward the predetermined direction of travel. While the blade is shifted to the second position, it is determined that the machine is again traveling in the predetermined direction. In response to the determination that the machine is again traveling in the predetermined direction, the lateral centerline of the dozer blade is shifted back to the first position.

In another aspect of this invention, an earth working machine comprises a driving portion having a longitudinal centerline and a dozer blade connected with the driving portion. The dozer blade extends transverse to the longitudinal centerline of the driving portion and has a lateral centerline. A steering mechanism is adapted to shift the lateral centerline of the dozer blade laterally relative to the longitudinal centerline of the driving portion to thereby cause the machine to change its direction of travel.

In a related aspect, the earth working machine further comprises automated means for determining that the machine has deviated from a desired direction of travel and means responsive to the determining means for automatically activating the steering mechanism to shift the lateral centerline of the blade relative to the longitudinal centerline of the driving portion until the machine is again traveling in the desired direction.

BRIEF DESCRIPTION OF THE DRAWINGS

FIG. 1 shows the dozer blade thereof with its lateral centerline aligned with the longitudinal centerline of the tractor.

BEST MODE FOR CARRYING OUT THE INVENTION

Figure 1:
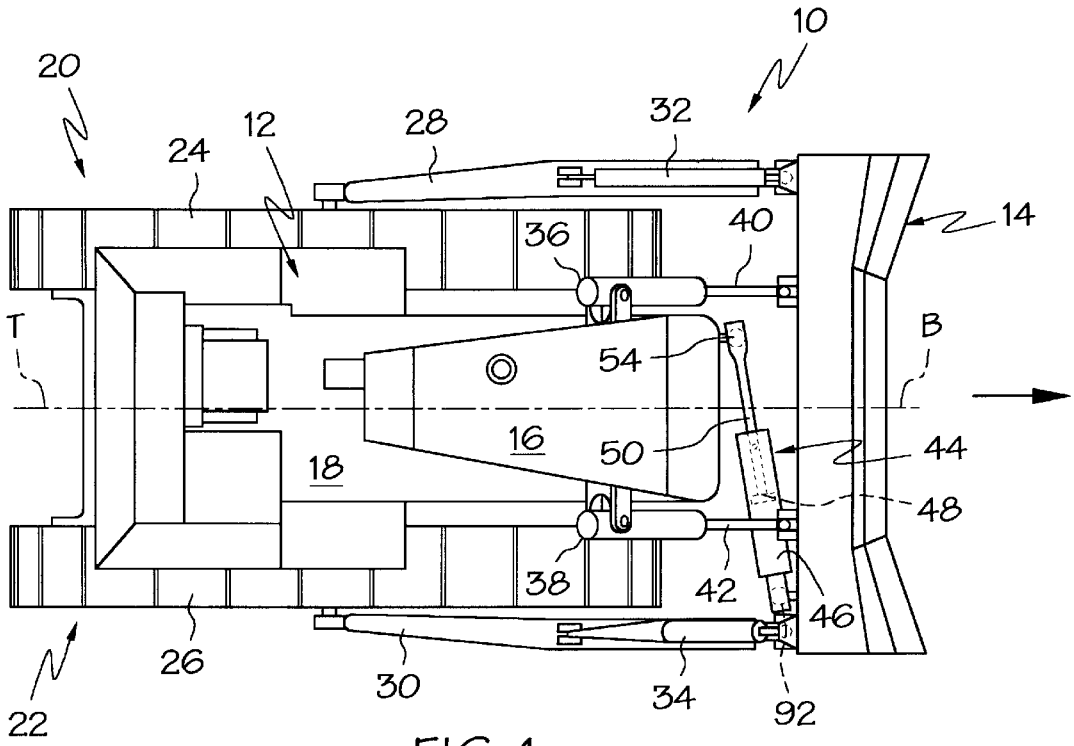
FIG. 1 is a top plan view of a track-driven dozing machine in accordance with this invention.

FIG. 1 illustrates a dozing machine, generally designated 10, in accordance with this invention. The machine 10 comprises a tractor 12 having mounted at its forward end a dozer blade 14. The illustrated tractor 12 is a track-driven machine having a mainframe (not shown), an engine compartment 16, an operator's station 18, and conventional left and right side track assemblies 20 and 22. As well known in the art, each of the track assemblies 20,22 comprises a track roller frame (not shown) mounted to a respective side of the tractor mainframe and an endless driven track 24, 26. It will be understood, however, that various aspects of this invention may also be useful with wheel tractors that utilize articulation steering, kingpin steering, skid steering, or any combination thereof.

The dozer blade 14 is transverse to the longitudinal centerline, designated T, of the tractor 12 and is located closely adjacent the forward end of the tractor 12. As used herein, "transverse" is intended to mean that the plane of the blade 14 intersects the centerline T of the tractor 12, but not necessarily at a right angle thereto. The blade 14 is carried at the forward ends of laterally-spaced left and right push arms 28, 30 which are pivotally mounted in a conventional manner to the corresponding track roller frames (not shown) and thus to the tractor 12. Alternatively, the push arms 28, 30 could be mounted directly to the tractor mainframe.

With continued reference to FIG. 1, the blade 14 is pivotally connected to the forward ends of the push arms 28, 30 and is normally held in an upright or generally vertical position by braces 32 and 34 which are connected between the push arms 28, 30, respectively, and the back of the blade 14. The brace 34 includes an actuator which may be hydraulically actuated to pitch the blade forward or aft. The blade is raised and lowered in a conventional manner by hydraulic actuators 36, 38 supported on opposite sides of the engine compartment 16 and having reciprocal rods 40, 42 pivotally connected to the back of the blade 14.

Typical known dozing machines utilize a rigid transverse brace or so-called tag link connected between (a) the dozer blade or a push arm and (b)the forward end of the tractor frame, as illustrated in commonly-owned U.S. Pat. No. 3,941,195 issued on Mar. 2, 1976 to Stedman. The tag link of the '195 construction is provided to absorb transverse forces against the blade, such as the forces which occur when the end of the blade encounters a stationary object for example.

Referring still to FIG. 1 and in accordance with this invention, the rigid brace or tag link as illustrated in the '195 patent is replaced by a conventional linear actuator 44, which shall be referred to hereafter as the blade shift actuator 44. The illustrated blade shift actuator 44 is a fluid-powered actuator comprising a hollow cylinder 46, a piston 48 movable reciprocally within the cylinder 46, and a rod 50 connected with the piston 48 for movement therewith and projecting from the cylinder 46. However, one skilled in the art will recognize that other suitable types blade shift actuators may be used, such as an electrically-powered linear actuator or a screw-type linear actuator.

The free end of the cylinder 44 is secured to the back side of the dozer blade 14 by way of a conventional ball and socket joint 52. Similarly, the free end of the rod 50 is connected with the mainframe (not shown) of the tractor 12 by a ball and socket joint 54. With reference to the U.S. Pat. No. 3,941,195, the rod 50 may be connected directly with the tractor mainframe (not show) or indirectly via an auxiliary C-frame (not shown) having its free ends connected to the tractor mainframe by ball and socket joints (not shown). One skilled in the art will recognize that the actuator 44 may also be reversed so that the rod 50 is connected with the back of the blade 14 and the cylinder 46 is connected with the tractor mainframe.

Figure 2:
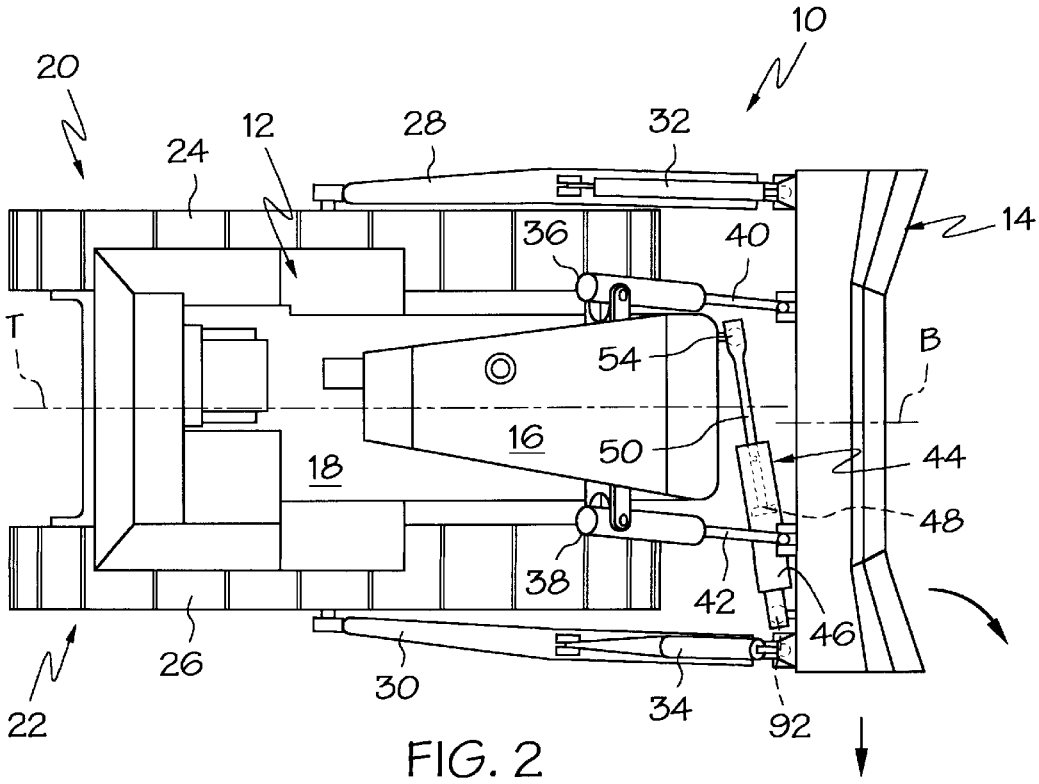
FIG. 2 is a plan view similar to FIG. 1, but showing the lateral centerline of the dozer blade shifted laterally to one side of the tractor centerline.

The blade shift actuator 44 may be supplied in a conventional manner with a fluid under pressure, preferably oil, either ahead of or behind the piston 48 to retract or extend the rod 50, as the case may be. As result, the length of the blade shift actuator 44 is changed and causes the blade 14 to be shifted to one side or the other relative to the longitudinal centerline T of the tractor 12, as shown in FIG. 2. More specifically, the lateral centerline, designated B, of the blade 14 is shifted laterally relative to the centerline T of the tractor 12. As will be described below in greater detail, this shifting of the blade centerline B creates a positive yaw rate, i.e. the machine 10 turns left or right depending on the direction of blade shift.

Suitable blade shift actuator controls, which may be conventional and are not illustrated, are provided at the operator's station 18 to selectively extend or retract the piston 48 and rod 50 on demand to thereby lengthen or shorten the actuator 44. In addition, as will be described, automated controls may also be provided to automatically shift the centerline B of the blade 14 relative to the tractor centerline T to maintain travel in a predetermined straight-line direction.

Figure 3:
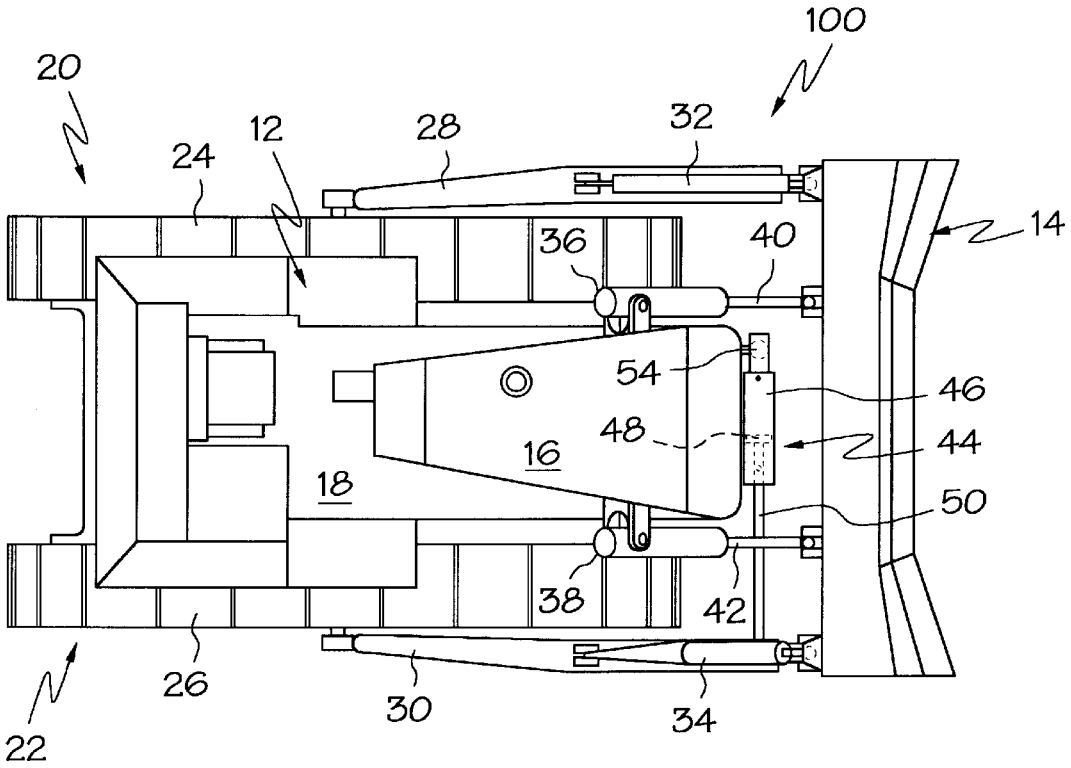
FIG. 3 is also a plan view similar to FIG. 1, but illustrates a second embodiment of a dozing machine in accordance with this invention.

FIG. 3 illustrates a second embodiment of a dozing machine, generally designated 100, in accordance with this invention. The machine 100 may be substantially identical to the machine 10 except for the mounting of the blade shift actuator 44. Accordingly, like part are give like reference numbers. As illustrated in FIG. 3, the blade shift actuator 44 is connected between the tractor mainframe (not shown) and one of the push arms 28, 30—in this case the right side push arm 30. The operation of the machine 100 will be apparent to one skilled in the art from the foregoing description of the machine 10, so further discussion of the machine 100 is omitted.

INDUSTRIAL APPLICABILITY

The provision of the blade shift actuator 44 permits the lateral centerline B of the blade 14 to be shifted relative to the longitudinal centerline T of the tractor 12 to steer the machine 10, 100 as described above. Such steering results because the line of action of the net forces acting against the blade 14 is thereby shifted laterally relative the centerline T of the tractor 12 and the then-current direction of travel. Because the blade 14 is permitted to remain in the same horizontal plane while still steering the tractor 12, there is no adverse effect on the dozed surface as found when using blade tilt to steer the tractor. As a result, an effective mechanism is provided to make minor steering corrections while maintaining the speed of the ground-engaging tracks.

Figure 4:
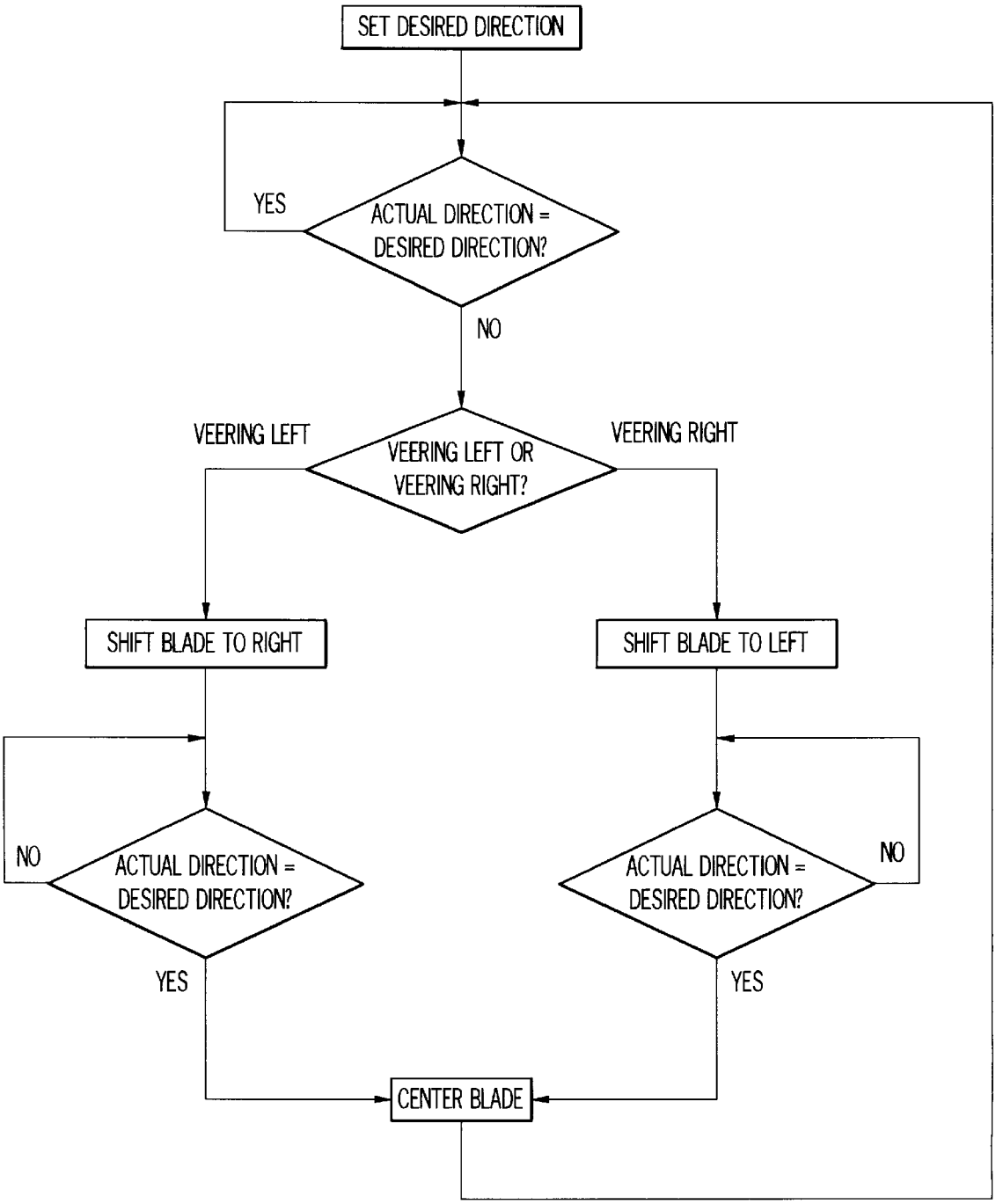
FIG. 4 is a flow chart illustrating an automatic straight-line travel control system in accordance with this invention.

Referring to FIG. 4, the lateral side shifting of the blade 14 in accordance with this invention may also be used effectively with an automatic straight-line travel control system. The operator's station may be provided with a selectively engageable automatic steering controls (not shown) that engage a system, which may be suitable software controls, that automatically side shifts the centerline B of the blade 14 as needed to maintain a desired straight-line direction of travel. An example of a straight-line travel control system that utilizes blade tilt rather than blade shift is illustrated and described in the aforementioned U.S. Pat. No. 5,487,428. Here it will be noted that in cases where the blade shift actuator 44 is used to achieve automatic straight-line travel, it is desirable that the actuator 44 be a fast-acting actuator so that responsive steering inputs can be made.

When the automatic steering system is engaged, the then-current direction of travel of the machine 10, 100 is typically set as the desired direction of straight-line travel. As the machine 10, 100 travels, the system continuously queries whether the machine's actual direction of travel is within an acceptable range of the desired direction of travel. A deviation from the desired direction of travel can be determined in a variety ways, such as the use of an inertial navigation system, a Global Positioning System (GPS), or a combination of pitch, roll, yaw, and velocity sensors or gyros, as the case may be. It is also contemplated that an arrangement of fixed laser transmitters (not shown) spaced around a work site could be used in conjunction with a laser receiver on the tractor 12 to determine the machine's actual direction of travel.

If it is determined that the machine 10, 100 is veering from its desired direction of travel, an indication is made that the machine 10, 100 is veering to the left or to the right of the desired direction of travel. If the machine is veering to the left, the lateral centerline B of the blade 14 is automatically shifted to the right to steer the machine 10, 100 to the right. The machine 10, 100 continues to be turned to the right by the blade centerline shift until the system determines that the actual direction of travel is again the desired direction of travel, at which time the centerline B of the blade 14 is immediately shifted back to its original position. Although the original position of the blade 14 is typically in substantial alignment with the longitudinal centerline T of the tractor 12, there may be cases, such as in side bank operations for example, in which the blade 14 is not centered on the tractor 12 while maintaining straight-line travel. If it is determined that the machine 10, 100 is veering to the right, similar actions occurs except that the lateral centerline B of the blade 14 is shifted to the left to steer the machine 10, 100 to the left.

It will also be noted that blade shift steering may be used in a straight-line travel system having less automation, for example in a system in which deviations from a desired direction of travel are simply indicated to the operator, as by indicator lamps for example, and appropriate manual steering changes are made by the operator by temporarily shifting the lateral centerline B of the blade 14.

There may be instances in which the deviation from the desired direction of travel is so significant that the amount of steering correction available from blade centerline shifting is not sufficient to promptly steer the machine 10, 100 back onto its desired course. In these cases, it may be necessary to utilize the differential steering capability of the tractor 12 to affect rapid and substantial course corrections. Commonly-owned U.S. patent application Ser. No. 08/909,169, filed on Aug. 11, 1997, discloses a method and apparatus for automatically determining, based on the magnitude of deviation from the desired direction of travel, whether corrections should be made by blade-type steering or by track steering. Although the '169 application is directed to the use of blade tilt steering, it will be understood that the teachings of the '169 application are equally applicable to the use of blade centerline shifting to make minor steering corrections. To this end, the disclosure of the '169 application is hereby incorporated by reference herein.

As explained above, steering adjustments are made by shifting the lateral centerline B of the dozer blade 14 laterally relative to the longitudinal centerline T of the tractor 12. It will be understood that such shifting can be accomplished not only by shifting the entire dozer blade 14 to one side as illustrated, but also by extending the length of the dozer blade 14 so as to shift the location of its lateral centerline. For example, U.S. Pat. No. 4,369,847 issued on Jan. 25, 1983, to Mizunuma illustrates and describes a suitable mechanism for varying the width of a blade which could effectively be used to shift the lateral centerline of the blade 14. Of course, other suitable means could also be used.

One skilled in the art will recognize that the automatic steering by shifting the centerline B of the blade 14 as described above is also useful with GPS, for example, in providing autonomous machine operation. In addition to use in affecting minor steering changes, blade side shifting is also useful for other non-steering purposes. For example, the centerline B of the blade 14 may be side shifted during pioneering or side bank cutting to provide less of an offset between the corner of the blade 14 and the tractor 12. In addition, the blade may be shifted to one side when working next to a ledge or trench to space the tractor 12 farther from the ledge or trench. In the case of a blade 14 that is otherwise fixed in a position substantially perpendicular to the direction of travel, the side shifting also angles the blade slightly.

Although the presently preferred embodiments of this invention have been described, it will be understood that within the purview of the invention various changes may be made within the scope of the following claims.

We claim:

1. A method for controlling the direction of travel of an earth working machine comprising a driving portion having a ground-engaging dozer blade at one end thereof which extends transverse to a longitudinal centerline of said driving portion, said dozer blade having a lateral centerline, comprising the steps of:

with the lateral centerline of said dozer blade located at a first position relative to longitudinal centerline of said driving portion, causing said work machine to travel in a predetermined direction of travel; and while said machine is traveling, causing said machine to change its direction of travel by shifting the lateral centerline of said dozer blade to a second position relative to said longitudinal centerline, said second position being spaced laterally from said first position.

2. The method of claim 1 wherein said blade has opposite ends and wherein said ends do not move vertically relative to said driving portion during said shifting step.

3. The method of claim 1 further comprising the steps of:

maintaining the lateral centerline of said dozer blade in said second position until said machine is traveling in a desired direction; and when said machine is traveling in said desired direction, shifting the lateral centerline of said machine back to said first position.

4. The method of claim 1 wherein said machine comprises a track driven machine.

5. The method of claim 1 wherein said lateral centerline of said dozer blade, when in said first position, is substantially coincident with the longitudinal centerline of said machine.

6. The method of claim 1 wherein said step of shifting said lateral centerline of said dozer blade comprises shifting the entire dozer blade laterally relative to the longitudinal axis of said machine.

7. The method of claim 6 wherein said dozer blade is connected with said machine by at least one push arm and by a variable-length steering control member extending between said dozer blade and said driving portion, and wherein said shifting steps comprise varying the length of said steering control member.

8. The method of claim 7 wherein said steering control member comprises a linear actuator.

9. The method of claim 8 wherein said actuator comprises a fluid-powered actuator.

10. The method of claim 6 wherein said dozer blade is connected with said machine by at least one push arm and by a variable-length steering control member extending between said dozer blade and said at least one push arm, and wherein said shifting steps comprise varying the length of said steering control member.

11. The method of claim 10 wherein said steering control member comprises a linear actuator.

12. The method of claim 11 wherein said actuator comprises a fluid-powered actuator.

13. The method of claim 1 further comprising the steps of:

prior to shifting the lateral centerline of said dozer blade to said second position, determining that said machine is no longer traveling in said predetermined direction;

wherein shifting of the lateral centerline of said blade to said second position is in response to said determining step and causes said machine to steer toward said predetermined direction of travel;

while said blade is shifted to said second position, determining that said machine is again traveling in said predetermined direction; and in response to said determination that said machine is again traveling in said predetermined direction, shifting said lateral centerline of said dozer blade back to said first position.

14. In an earth working machine comprising a driving portion and a dozer blade connected with said driving portion, said driving portion having a longitudinal centerline and said dozer blade extending transversely to said longitudinal centerline of said driving portion, said dozer blade having a lateral centerline, the improvement comprising:

a steering mechanism adapted to shift the lateral centerline of said dozer blade laterally relative to said longitudinal centerline of said driving portion to thereby cause said machine to change its direction of travel.

15. The improvement of claim 14 wherein said steering mechanism comprises a variable-length steering member connected between said dozer blade and said driving portion of said machine, the length of said steering member being variable on demand to shift the lateral centerline of said dozer blade with respect to the longitudinal centerline of said driving portion.

16. The improvement of claim 15 wherein said variable-length member comprises a linear actuator.

17. The improvement of claim 16 wherein said actuator comprises a fluid-powered actuator.

18. The improvement of claim 14 wherein said dozer blade is connected with said driving portion of said machine by at least one push arm and wherein said steering mechanism comprises a variable-length member connected between said at least one push arm and said driving portion, the length of said steering member being variable on demand to shift the lateral centerline of said dozer blade with respect to the longitudinal centerline of said driving portion.

19. The improvement of claim 18 wherein said variable-length member comprises a linear actuator.

20. The improvement of claim 19 wherein said actuator comprises a fluid-powered actuator.

21. An earth working machine, comprising:

a driving portion having a longitudinal centerline;

a dozer blade connected with said driving portion, said dozer blade extending transverse to said longitudinal centerline of said driving portion and having a lateral centerline; and a steering mechanism adapted to shift the lateral centerline of said dozer blade laterally relative to said longitudinal centerline of said driving portion to thereby cause said machine to change its direction of travel.

22. The earth working machine of claim 21 further comprising:

automated means for determining that said machine has deviated from a desired direction of travel; and means responsive to said determining means for automatically activating said steering mechanism to shift the lateral centerline of said blade relative to the longitudinal centerline of said driving portion until said machine is again traveling in said desired direction.

23. The earth working machine of claim 22 wherein said steering mechanism comprises a variable-length steering member connected between said blade and said driving portion.

24. The earth working machine of claim 22 wherein said steering member is connected between said driving portion and a push arm connecting said driving portion with said blade.

25. An earth working machine, comprising:

a driving portion having a longitudinal centerline;

a dozer blade connected with said driving portion and extending transversely to said longitudinal centerline of said driving portion, said dozer blade having a lateral centerline; and means for steering said machine by shifting the lateral centerline of said dozer blade laterally relative to said longitudinal centerline of said driving portion to thereby cause said machine to change its direction of travel.

26. The earth working machine of claim 25, wherein said means for steering comprises a fluid-powered linear actuator.

* * * * *